United States Patent [19]

Minami et al.

[11] Patent Number: 4,568,622

[45] Date of Patent: Feb. 4, 1986

[54] ELECTROPHOTOGRAPHIC PHOTOSENSITIVE MEMBER AND METHOD FOR MAKING SUCH A MEMBER CONTAINING AMORPHOUS SILICON

[75] Inventors: Koji Minami, Higashiosaka; Kazuyuki Goto; Hisao Haku, both of Hirakata; Takeo Fukatsu, Uji; Michitoshi Ohnishi, Yawata; Yukinori Kuwano, Katano, all of Japan

[73] Assignee: Sanyo Electric Co., Ltd., Osaka, Japan

[21] Appl. No.: 621,087

[22] Filed: Jun. 15, 1984

[30] Foreign Application Priority Data

Jun. 21, 1983 [JP] Japan ..... 58-112094

[51] Int. Cl.[4] ..... G03G 5/082

[52] U.S. Cl. ..... 430/57; 430/61; 430/84; 430/95; 430/135

[58] Field of Search ..... 430/57, 84, 85, 86, 430/95, 60, 64, 65, 66, 135

[56] References Cited

U.S. PATENT DOCUMENTS

| | | | |
|---|---|---|---|
| 4,409,311 | 10/1983 | Kawamura et al. | 430/95 |
| 4,460,669 | 7/1984 | Ogawa et al. | 430/95 |
| 4,484,809 | 11/1984 | Coleman | 430/95 |

*Primary Examiner*—John L. Goodrow

*Attorney, Agent, or Firm*—W. G. Fasse; D. H. Kane, Jr.

[57] ABSTRACT

An electrophotographic photosensitive member has a conductive substrate, a first layer structure with a single layer made mainly of amorphous silicon formed on the substrate, and a second layer structure including multiple layers also mainly made of amorphous silicon layered in succession on the first layer structure. The plurality of second layers includes at least two high resistance layers having a relatively high resistance value and at least one low resistance layer having a relatively low resistance value compared to the high resistance value. The layers of the second layer structure are layered alternately on the first layer structure so that the first and last layers in the second layer structure are high resistance layers.

24 Claims, 5 Drawing Figures

ELECTROPHOTOGRAPHIC PHOTOSENSITIVE MEMBER AND METHOD FOR MAKING SUCH A MEMBER CONTAINING AMORPHOUS SILICON

BACKGROUND OF THE INVENTION

1. Field of the Invention

The present invention relates to an electrophotographic photosensitive member also called a "photoreceptor", and to a method for making such a member or photoreceptor. More specifically, the present invention relates to an electrophotographic photosensitive member having a photoconductive layer made mainly of amorphous silicon.

2. Description of the Prior Art

Recently, amorphous silicon has been used in place of selenium or cadmium sulfide as a photoconductive material constituting a photoconductive layer of an electrophotographic photosensitive member. In comparison with an electrophotographic photosensitive member made mainly of selenium or cadmium sulfide, an electrophotographic photosensitive member made mainly of amorphous silicon has various advantages, for example it has a superior heat resisting property and an abrasion resisting property, it is harmless to its environment, and it has a high photosensitivity, among other advantages. Since an electrophotographic photosensitive member made mainly of amorphous silicon has an ample sensitivity even with respect to light of a longer wavelength, it can be used not only in an electrophotographic machine but also in an intelligent copier utilizing a laser printer, an LED printer and the like.

However, in an electrophotograhic photosensitive member with amorphous silicon there is a phenomenon which results in a degrading of the surface of the photoconductive layer due to repetition of the electric charging whereby the resolution becomes poor. In case of an electrophotographic photosensitive member having a photoconductive layer made of selenium or cadmium sulfide, the degraded portion is gradually abraded by a cleaning action forming part of the repetition of an electrophotographic process because of a low hardness of the surface whereby it is not necessary to positively abrade the degraded portion. However, in case of an electrophotographic photosensitive member having a photoconductive layer made mainly of amorphous silicon, the surface is hardly abraded by the repetitive electrophotographic processes because the surface of amorphous silicon has a high hardness. Accordingly, it is necessary to abrade the silicon surface to remove the degraded portion each time when several thousand of electrophotographic processes have been completed.

Although a cause of degradation of the surface of a photoconductive layer has not yet been fully clarified, it is presumed that the degradation occurs due to a decrease in the dark resistance. Generally, a photoconductive layer of amorphous silicon is doped with an amount of an additive such as oxygen, nitrogen or the like in order to provide the dark resistance necessary for operating as an electrophotographic photosensitive member. One of the reasons why the dark resistance is reduced is said to be the occurrence of nitrogen ions when the surface of a photoconductive layer is subjected to a corona discharge caused by a high voltage, whereby these nitrogen ions or the like are chemically coupled to the additive or dopant for increasing the dark resistance. Another reason is said to be that nitrogen ions and oxygen ions attached to the surface due to the corona discharge are liable to produce $HNO_3$. The reason is that $HNO_3$ adsorbs moisture and the moisture on the surface of a photoconductive layer decreases the resistance on the surface. One possible approach to be considered to prevent a decrease of the dark resistance is to initially dope the material with a large amount of such an additive. However, in such a case, another problem arises namely that the resistance becomes too large and the sensitivity is decreased.

SUMMARY OF THE INVENTION

In accordance with the present invention, an electrophotographic photosensitive member comprises a conductive substrate, a first layer structure including a single layer formed on the substrate and made mainly of amorphous silicon, and a second layer structure including a plurality of individual layers formed on the first layer also mainly made of amorphous silicon. The second layer structure comprises high resistance layers each having a relatively high resistance value and a low resistance layer having a relatively low resistance value. The high resistance layers and the low resistance layer are layered alternately on the first layer structure such that the first and last layers of the second layer structure are the high resistance layers.

Accordingly, a principal object of the present invention is to provide an improved electrophotographic photosensitive member which is subject to a little degradation of the surface layer thereof and hence will maintain substantially its resolution during usage.

Another object of the present invention is to provide an improved electrophotographic photosensitive member having an extreme stability relative to environmental variations.

The present invention makes it possible to implement an electrophotographic photosensitive member of high sensitivity and a long useful life due to an interaction of the respective layers of the second layer structure constituting a multiple layer structure.

Since the electrophotographic photosensitive member according to the invention shows little degradation of the surface of the photoconductive layer, the difficult task of abrading the surface is avoided.

It has been observed that the present electrophotographic photosensitive member exhibits excellent results even in a severe temperature, humidity cycling test.

These objects and other objects, features, aspects and advantages of the present invention will become more apparent from the following detailed description of the present invention when taken in conjunction with the accompanying drawings.

DETAILED DESCRIPTION OF PREFERRED EMBODIMENTS AND OF THE BEST MODE OF THE INVENTION

Figure 1:
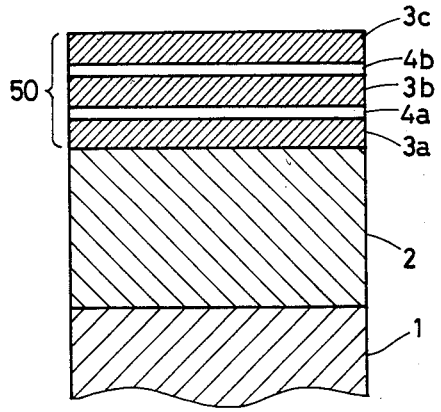
FIG. 1 is a partial, enlarged sectional view through an electrophotographic photosensitive member in accordance with a preferred embodiment of the present invention.

FIG. 1 shows the fundamental structure of an electrophotographic photosensitive member in accordance with the present invention, comprising a conductive substrate 1, a single first layer structure 2 forming a single layer made mainly of amorphous silicon formed on the conductive substrate 1, and a second layer structure 50 comprising a plurality of individual layers also made mainly of amorphous silicon formed on the single first layer 2. The material of the conductive substrate 1 may be metal selected from a group comprising aluminum, stainless steel, chromium, molybdenum and the like or an alloy of these metals. The single first layer 2 corresponds to a photoconductive layer formed of amorphous silicon in a conventional electrophotographic photosensitive member which is doped, as necessary, with such a substance as oxygen or the like for increasing the resistance value of amorphous silicon. The second layer structure 50 of the embodiment comprises fine distinct layers. The number of layers may be increased or decreased as necessary. The 5-layer structure comprises first, second and third high resistance layers 3*a*, 3*b*, and 3*c* having a relatively high resistance value, and first and second low resistance layers 4*a* and 4*b* having a relatively low resistance value. The low resistance layers are sandwiched between the high resistance layers so that the first and last layer in the five layer structure are high resistance layers.

For the purpose of adjusting the resistance values of the high resistance layer and of the low resistance layer to desired values, preferably the amorphous silicon is doped with impurities. Such impurities are selected from the group comprising oxygen, carbon, the group III elements and the group V elements. A resistance value larger than approximately $10^9$ Ωcm is practicable for the high resistance layers and the resistance value smaller than approximately 1/10 of the resistance value of the high resistance layer is practicable for the low resistance layers. However, it has been confirmed that the present electrophotographic photosensitive member operates in a more preferred way when the resistance value of the high resistance layer is selected to be larger than $10^{11}$ Ωcm. Although a practical range of the thickness of both the high resistance layers and the low resistance layers is 10 Å to 200 μm, preferably the thickness is selected in the range of 50 Å to 100 μm.

A method for forming the first single layer structure, the high resistance layers and the low resistance layers may comprise a glow discharge process, a sputtering process, an ion implantation process or the like. However, from the practical standpoint a glow discharge process is most preferable. Accordingly, a process of manufacturing the present electrophotographic photosensitive member as shown in FIG. 1 in accordance with a glow discharge process will now be described with reference to FIGS. 2 and 3.

Figure 2:
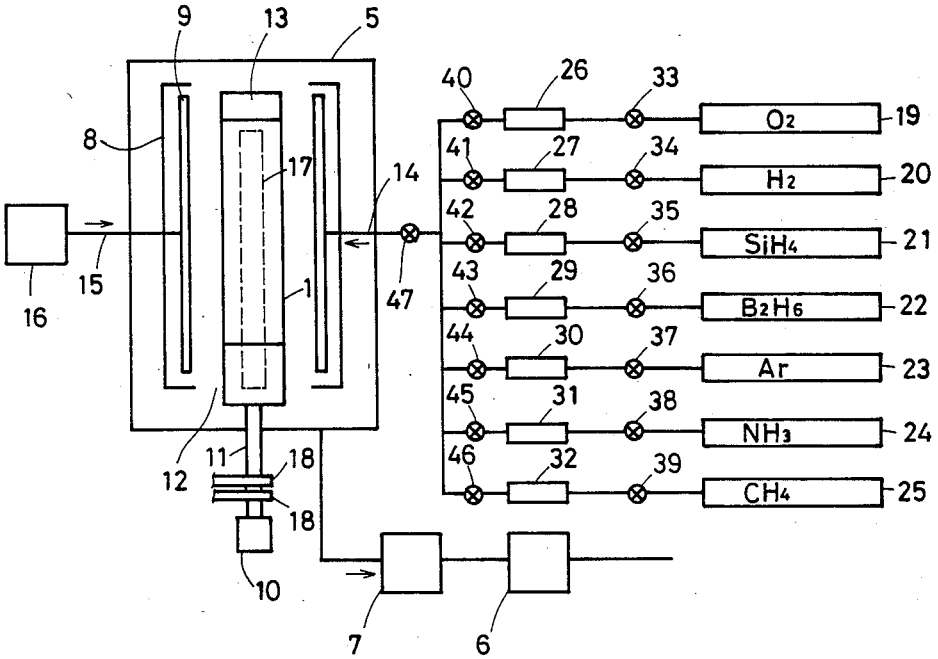
FIG. 2 is a block diagram of a glow discharge apparatus for use in the fabrication of an electrophotographic photosensitive member in accordance with the present invention.
Figure 3:
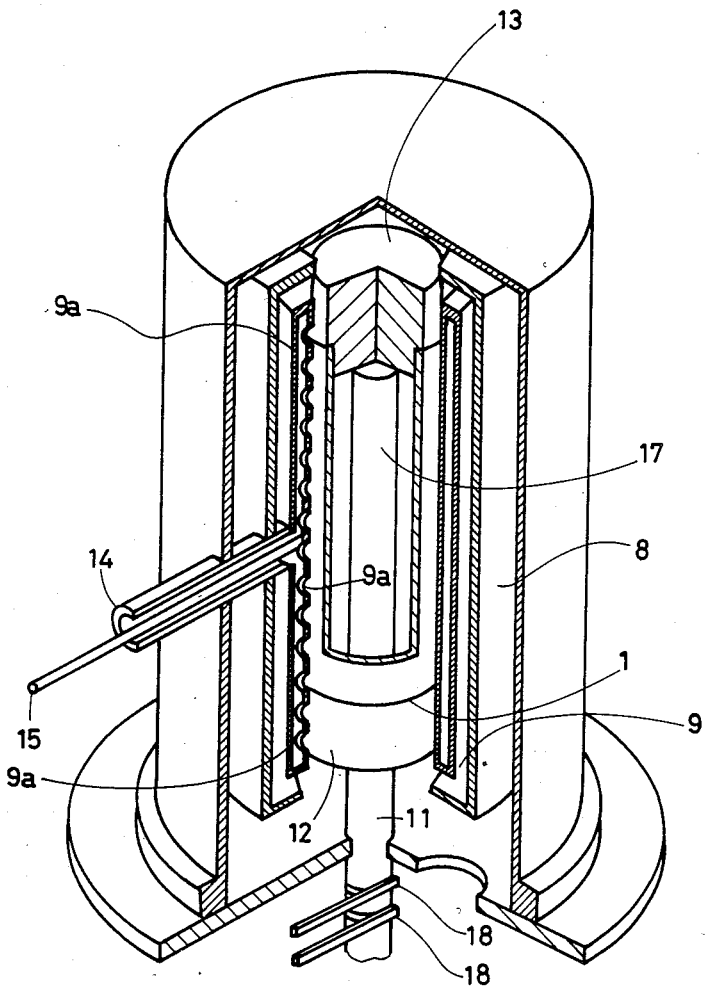
FIG. 3 is a perspective, partially fragmentary view of a glow discharge apparatus for use in the fabrication of an electrophotographic photosensitive member in accordance with the present invention.

The glow discharge apparatus shown in FIGS. 2 and 3 comprises a hollow cylindrical vessel 5 for receiving an electrophotographic photosensitive member and various kinds of gases. The vessel 5 is directly coupled to a rotary pump 6 and a mechanical booster pump 7 for evacuating gases out of the vessel 5. Where a high vacuum is required, a molecular turbopump, not shown, may be provided in parallel with the mechanical booster pump 7. A plasma shield 8 of a cylindrical shape, U-letter shaped in section, is provided inside the vessel 5. A cylindrical and hollow tubular electrode 9 is provided inside the plasma shield 8 and a cylindrical member 1 serving as a substrate of an electrophotographic photosensitive member is inserted inside the electrode 9. The cylindrical member 1 is placed on a holder 12 fixed to a rotating shaft 11 of a motor 10, while a cover 13 for closing the opening is provided at the upper end of the member 1. A gas supplying pipe 14 extends through the wall of the vessel 5, the plasma shield 8 and the outside wall of the electrode 9 in a direction orthogonal to the rotational, central axis. A conductive wire 15 for applying a high frequency power is inserted into the electrode 9. A plurality of apertures 9*a* are formed in a row in the electrode 9 in parallel with the rotational axis. The apertures 9*a* whole surface of the inner wall of the electrode 9 or alternatively may be formed in a portion of the inner wall of the electrode 9. The conductive wire 15 is coupled to a high frequency source 16 for supplying a high frequency power. A rod like heater 17 is inserted inside the cylindrical member 1 and the lower end of the heater 17 is fixed to the holder 12. Brushes 18 are provided on the rotational shaft 11 for supplying power to the heater 17.

Gas cylinders 19 to 25 are provided as necessary. In the embodiment shown, an oxygen ($O_2$) gas cylinder 19, a hydrogen ($H_2$) gas cylinder 20, a monosilane ($SiH_4$) gas cylinder 21, a diborane ($B_2H_6$) gas cylinder 22, an argon (Ar) gas cylinder 23, an ammonia ($NH_3$) gas cylinder 24, and a methane ($CH_4$) gas cylinder 25 are utilized. These gas cylinders are coupled through valves 33 to 39 for opening or closing the respective gas passages to mass flow controllers 26 to 32, respectively, and further through separate valves 40 to 46 and a common valve 47 to the gas supply pipe 14.

The present electrophotographic photosensitive member as shown in FIG. 3 is fabricated by means of the above described glow discharge apparatus in accordance with the following steps. The thickness of the first layer 2 is selected to be 20 μm, the thicknesses of the high resistance layers 3*a*, 3*b* and 3*c* are selected to be 1,000 Å, and the thicknesses of the low resistance layers 4*a* and 4*b* are selected to be 100 Å. The resistance value of the first layer 2 is selected to be $10^{13}$ Ωcm, the resistance values of the high resistance layers 3*a*, 3*b* and 3*c* are selected to be $10^{14}$ Ωcm, and the resistance values of the low resistance layers 4*a* and 4*b* are selected to be $10^8$ Ωcm.

The table shown below illustrates various reaction conditions in the fabrication of the present electrophotographic photosensitive member. Specifically, the flow rate ratios of the gases from the gas cylinders 19 to 25 are shown in the reaction conditions I to VII in the table and will be described in the following with reference to the table. For example, aluminum is selected as the material of the substrate in the form of the cylindrical member 1 which is first mounted on the holder 12. The outer wall of the cylindrical member 11 is super-finished. Then, after the upper opening of the cylindrical member 1 is closed with the cover 13, the air inside the vessel 5 is evacuated by means of the rotary pump 6 and the mechanical booster pump 7 or the molecular turbopump (not shown) to the extent of $1\times10^{-6}$ Torr. The heater 17 is energized so that the cylindrical member 1 is heated up to 250° C. The above described heating temperature is one of the factors for determining the growth rate of the layer, the property of the layer to be formed and the like and preferably is selected in the range of 200° C. to 300° C. The heating temperature of 250° C. is maintained during the following steps of forming the respective layers. The cylindrical member 1 is rotated at the speed of 10 rpm by the motor 10. The cylindrical member 1 is rotated for the purpose of achieving uniformity in the formed layers and hence any proper rotational speed may be selected for that purpose.

Then the valves 37, 44 and 47 are opened and the argon gas is admitted into the vessel 5 under the control of the flow rate by the mass flow controller 30, thereby to maintain the internal pressure at 1 Torr. A hydrogen gas or a carbon tetrafluoride ($CF_4$) gas may be used together with or in place of an argon gas. Thus, at least one of these gases may be used. A high frequency power of 50 W with the frequency of 13.56 MHz is applied between the electrode 9 and the cylindrical member 1 for approximately 20 minutes, whereby a glow discharge occurs for forming a very fine unevenness on the surface of the cylindrical member 1 facilitating the deposition of the photoconductive layer 2 thereon forming a single layer structure. After the unevenness is formed on the surface of the cylindrical member 1, the argon gas in the vessel 5 is evacuated by means of the rotary pump 6 and the mechanical booster pump 7, whereby the pressure in the vessel 5 is again reduced to a vacuum of approximatery $1\times10^{-3}$ Torr.

Then the valves 33 to 36 and 40 to 43 and 47 are opened, so that a monosilane gas, a diborane gas, an oxygen gas and a hydrogen gas are introduced into the vessel under the control of the flow rates by the mass controllers 26 to 29. The proportion of the flow rates of the respective gases is disclosed in the row of the first layer of the reaction conditions I in the table. The monosilane is shown by the flow-in rate per minute (cc/min), while the remaining gases are shown by the ratios of the flow rates thereof per minute with respect to that of the monosilane. The ratio of the flow rate of the diborane gas to that of the monosilane gas is shown in PPM. The hydrogen gas may be individually supplied from a hydrogen cylinder 20 or alternatively the same may be supplied as hydrogen in a hydrogen based diborane gas. While the respective gases are introduced into the vessel 5 under such control of the flow rates by the mass flow controllers 26 to 29, a high frequency power of 500 W with the frequency of 13.56 MHz is applied for approximately two hours between the electrode 9 and the cylindrical member 1, whereby a glow discharge is caused to occur. During that period of time the gases not reacted are exhausted from a valve, not shown, so that the pressure in the vessel is always maintained at 1 Torr. Thus the first layer 2 of hydride amorphous silicon with the resistance value of $10^{13}$ Ωcm and with boron and oxygen doped is formed on the surface of the cylindrical member 1 with the thickness of 20 μm. The above indicated numerical values of the factors such as the electric power, the frequency, the period of time and pressure should be taken by way of an example, inasmuch as those skilled in the art can form the first single layer structure 2 of hydride amorphous silicon similar to the foregoing by selecting these numerical values as any other proper values. The same applies also to the steps to be described in the following.

After the first single layer structure 2 is formed, the gas remaining in the vessel 5 is evacuated, so that the pressure in the vessel 5 is again brought to a vacuum of $1\times10^{-3}$ Torr. Then the valves 34, 35, 38, 41, 42, 45 and 47 are opened and a monosilane gas, an ammonia gas and a hydrogen gas are introduced into the vessel 5 with controlled flow rates by means of the mass flow controllers 27, 28 and 31. The ratios of the flow rates in this case are shown in the uppermost row (the row shown as **3*a*) for the second layer structure 50 of the reaction conditions I in the table. The pressure in the vessel 5 is maintained at 1 Torr as in the above described case. A high frequency power of 100 W and 13.56 MHz is applied between the electrode 9 and the cylindrical member 1 for approximately five minutes, so that a glow discharge occurs. Thus, the first high resistance layer 3*a* of the second layer structure 50** is made mainly of hydride amorphous silicon with a nitrogen doping and having the resistance value of $10^{14}$ Ωcm and a thickness of 1,000 Å.

Figure 4:
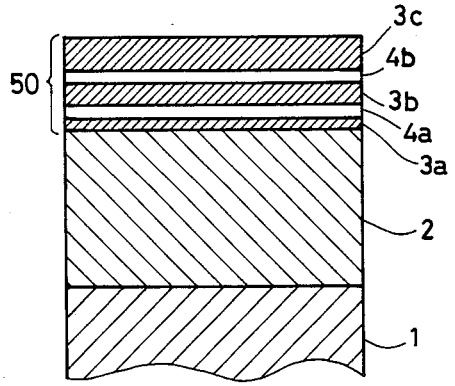
FIG. 4 is a partial, enlarged sectional view through an electrophotographic photosensitive member in accordance with another preferred embodiment of the present invention.

After the first high resistance layer **3*a* is formed, the gas remaining in the vessel 5 is evacuated and again the pressure in the vessel 5 is reduced to approximately $1\times10^{-3}$ Torr. Then the values 34 to 36, 41 to 43 and 47 are opened, so that a monosilane gas, a diborane gas and a hydrogen gas are introduced into the vessel 5 with the flow rates controlled by the mass flow controllers 27 to 29. The ratios of the flow rates of the respective gases in this case are shown in the row shown as 4*a* for the reaction conditions I in Table. The pressure in the vessel 5 is maintained at 1 Torr in the manner similar to the foregoing. A high frequency electric power of 50 W and 13.56 MHz is applied between the electrode 9 and the cylindrical member 1 for one minute, so that a glow discharge may occur. Thus, the first low resistance layer 4*a* of hydride amorphous silicon with only a boron doping having the lower resistance value of $10^8$ Ωcm is formed to the thickness of 100 Å. Although in the embodiment now being described the resistance value of the first low resistance layer 4*a* is smaller than the resistance value of first high resistance 3*a* layer, the resistance value of the second low resistance layer in the second layer 4*b* structure 50 may be the same or larger than the resistance value of the first low resistance layer 4*a*. The point is, that layers of of relatively different resistance values alternate with each other in the second layer structure 50 as shown in FIGS. 1 and 4**. The lower resistance value should preferably be smaller than 1/10 of the higher resistance value.

Under the same conditions as described in the foregoing the second high resistance layer **3*b*, the second low resistance layer 4*b* and the third high resistance layer 3*c* are formed in succession to make up the second layer structure 50**, in which the high resistance layers have a thickness of 1,000 Å and the resistance value of $10^{14}$ Ωcm, and wherein the low resistance layers have a thickness of 100 Å and the resistance value of $10^8$ Ωcm.

After the second layer structure 50 is formed, the cylindrical member 1 is gradually cooled and the same is taken out of the vessel 5. As a result the present electrophotographic photosensitive member is obtained.

In order to confirm the excellent properties of the present electrophotographic photosensitive member thus obtained, the same was subjected to a paper running test in which an electrophotographic process is repeated under cycling temperature and humidity conditions. The electrophotographic photosensitive member fabricated under the reaction conditions VII in the table was compared with a conventional electrophotographic photosensitive member having a single photoconductive layer made mainly of amorphous silicon formed on a substrate, similar to the structure shown in FIG. 1, but without the second layer structure 50 which is part of the invention as shown in the uppermost row of reaction conditions I in the table. The temperature/-humidity cycling test was conducted under such conditions that the upper limit of the temperature was 60° C. and of the humidity was 90%, while the lower temperature limit was −10° C. and the lower humidity limit was as high as possible at this lower temperature limit. The periods of the respective cycles in the temperature/humidity cycling test were selected to be one hour for the upper limit, two hours for transition from the upper limit to the lower limit, one hour for the lower limit and two hours for transition from the lower limit to the upper limit, totaling six hours for each full cycle. After the electrophotographic photosensitive member had been subjected to a suitable number of cycles in the temperature/humidity cycling test, the test sample was heated to a thermostat controlled temperature of 80° C. for thirty minutes and thereafter it was cooled to normal room temperature to assure uniform measuring conditions, whereupon the properties were measured.

In a paper running test, the present electrophotographic photosensitive member exhibited little degradation of the resolution even after running of 100,000 sheets of paper. By contrast, the conventional electrophotographic photosensitive member showed some degradation of the resolution after running of 5,000 sheets of paper. In the temperature/humidity cycling test, the present electrophotographic photosensitive member exhibited little degradation of the resolution even after the test cycles were repeated for 1,000 hours. By contrast, the conventional electrophotographic photosensitive member showed some degradation of the resolution after the same test of 1,000 hours. Thus, it is observed that as compared with the conventional test sample, the present electrophotographic photosensitive member exhibits very little degradation of the resolution due to usage for many hours and under changing environmental conditions. Accordingly, the present invention makes it possible to implement an electrophotographic photosensitive member having a substantially increased life as compared to the prior art sample. Although the reason for this improvement cannot be necessarily accounted for theoretically, it is presumed that the second layer structure 50 formed on the first layer structure 2, and comprising multiple individual layers of high resistance alternating with lower resistance layers and providing an interaction among such multiple layers could bring about such improvement. Another reason is presumed to be that since the outermost surface or layer is a high resistance layer having a relatively high resistance value, the resistance in the surface layer 3*c* is hardly decreased even by a number of times of use. Accordingly, the difficult work of abrading the surface, as required in conventional electrophotographic photosensitive members becomes unnecessary.

Figure 5A:
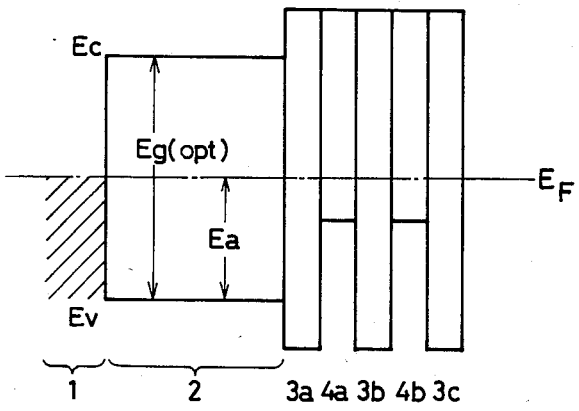
FIGS. 5A and 5B are views for explaining an energy band gap of an electrophotographic photosensitive member in accordance with the present invention.

As described in the foregoing, the present electrophotographic photosensitive member can realize a very long life by employment of the second layer structure including multiple layers, without reduction of the sensitivity due to the existence of the second layer structure. The reason is apparent by referring to the energy band gap views shown in FIGS. 5A and 5B. FIG. 5A is a view showing an outline of the energy band gap of the electrophotographic photosensitive member made under the condition I in the table when the member is not charged. Referring to FIG. 5A, briefly the optical band gap Eg(opt) is shown as a difference between the energy level Ec of the bottom of the conduction band and the energy level Ev at the top of the valence band. The activation energy Ea required for activating the carriers, i.e. the energy required for bringing the holes to the valence band in case of a P type semiconductor, for example, is shown as a difference between the Fermi level $E_F$ and the energy level $E_V$ at the top of the valence band. In the case of the electrophotographic photosensitive member according to the reaction condition I in the table, Eg(opt)≈1.9 eV and Ea≈0.95 eV in the first layer 2, Eg(opt)≈2.8 eV and Ea≈1.4 eV in the high resistance layers of the second layer structure 50, Eg(opt)≈1.75 eV and Ea≈0.35 eV in the low resistance layers of the second layer structure 50. In the case of the electrophotographic photosensitive member according to the reaction condition I in the table, the levels Eg(opt) and Ea have been adjusted such that the energy levels of the bottoms of the conduction bands of the high resistance layers and the lower resistance layers may be consistent with each other. Such adjustment can be made readily by those skilled in the art by properly changing the composition of each of the layers. If and when the amount of the hydrogen contained is changed in the range of 0% to 20% in purely hydride amorphous silicon, the optical band gap Eg(opt) changes in the range of 1.6 eV to 1.8 eV. Since an impurity doping has been used for increasing the resistance value in the respective layers, the optical band gap of these layers has become larger than that of the lower resistance value layers. The reason why the optical band gap of the first layer 2 is larger than the optical band gap of the lower resistance layers is that oxygen has been used for doping in the first layer 2.

Figure 5B:
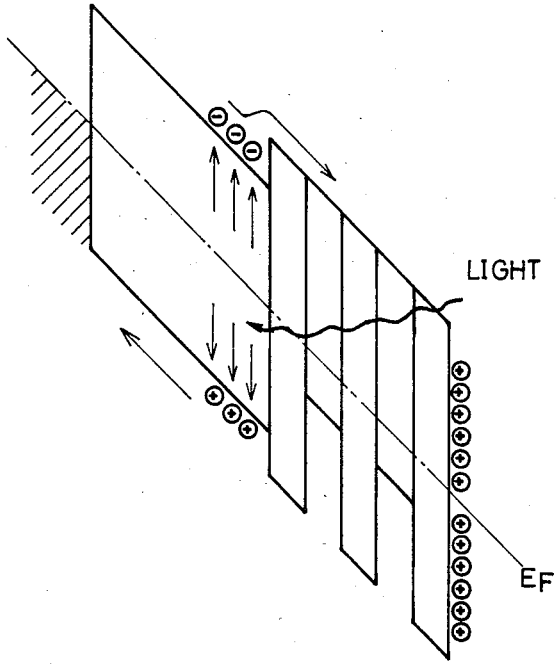

In case of positive charging, the energy band is inclined as shown in FIG. 5B. The light penetrates through the high resistance layers, inasmuch as the optical band gap of the high resistance layers is large. On the other hand, since the film thickness of the low resistance layers is smaller, little light is absorbed there. Accordingly, a major portion of the light is absorbed on the surface of the first layer, thereby to gives rise to electron/hole pairs. The electrons thus produced serve to cancel the positive electric charge stored as the positive charge on the surface of the second layer, while the holes go through toward the substrate. Since the energy level of the bottom of the conduction band of the second layer has been adjusted to be smooth as described above, movement of the electrons is carried out very smoothly. Accordingly, cancellation of the positive electric charge on the surface, i.e. reduction of the surface potential is performed very smoothly. Since the sensitivity is measured as an optical energy amount necessary for reduction of the surface potential to a half after light incidence, it will be readily appreciated that the sensitivity is not reduced due to the existence of the second layer structure 50. In the case where the electrophotographic photosensitive member is of the negative charging type, the same is adapted such that Eg(opt) and Ea are adjusted so that the energy level Ev at the top of the valence band of the second layer may become smooth.

Various modifications and changes can be made of the present invention. For example, as shown in FIG. 4, the thicknesses of the high resistance layers may be increased toward the outer surface. Alternatively, they may be decreased toward the outer surface. Referring to FIG. 4, the first high resistance layer 3*a* has a thickness of 100 Å, the second high resistance layer 3*b* has the thickness of 500 Å, and the third high resistance layer 3*c* has a thickness of 1,000 Å. Any other features of the electrophotographic photosensitive member shown in FIG. 4 are the same as those in the member shown in FIG. 1. The reaction conditions in fabricating the electrophotographic photosensitive member shown in FIG. 4 are shown by the reaction conditions II in the table. The changes of the film thicknesses can be readily made by adjusting the power and the application period of time of the high frequency power to be applied for generating the glow discharge, for example. Other factors, such as the frequency, the pressure and the like may be changed. The electrophotographic photosensitive member of the embodiment described above maintained the excellent resolution even after the paper running test of 50,000 sheets and also maintained the excellent resolution even after the temperature/humidity cycling test of 1,000 hours.

The reaction conditions III in the table show another embodiment of the present invention. The electrophotographic photosensitive member fabricated under these reaction conditions has substantially the same structure as that shown in FIG. 1. A different feature is that the resistance values of the high resistance layers are selected to be increased toward the outer surface. Such change can be carried out by changing the amount of nitrogen to be doped in the high resistance layers. To that end, the flow rate of an ammonia gas in forming the respective high resistance layers is changed. The first resistance layer 3*a* thus formed has a resistance value of $2\times10^{13}$ Ωcm and the second high resistance layer 3*b* thus formed has a resistance value of $5\times10^{13}$ Ωcm and the third high resistance layer thus formed has a resistance value of $10^{14}$ Ωcm. The electrophotographic photosensitive member employing the above described embodiment exhibited the excellent resolution even after the paper running test of 50,000 sheets and also maintained the excellent resolution even after the temperature/humidity cycling test of 1,000 hours.

The reaction conditions IV in the table show a further embodiment of the present invention. The electrophotographic photosensitive member fabricated under these reaction conditions is substantially the same as the embodiment shown in FIG. 1, except that the thickness of the first layer was changed from 20 μm to 40 μm. The electrophotographic photosensitive member employing the above described embodiment maintained the excellent resolution even after the paper running test of 100,000 sheets and maintained the excellent resolution even after the temperature/humidity cycling test of 1,000 hours. Thus, it will be appreciated that the thickness of the first layer may be properly changed.

The reaction conditions V in the table show still a further embodiment of the present invention. The structure of the electrophotographic photosensitive member fabricated under these reaction conditions is the same as the structure of the embodiment shown in FIG. 1. This embodiment has all the layers doped with boron and oxygen. The doping amount of oxygen is the same for the first layer structure 2 and for the lower resistance layers 4*a*, 4*b*, and the doping amount of oxygen for the high resistance layers 3*a*, 3*b*, 3*c* is increased toward the outer surface, whereby the resistance values of the high resistance layers are increased toward the outer surface. The so produced electrophotographic photosensitive member showed the excellent resolution even after the paper running test of 10,000 sheets and also showed the excellent resolution even after the temperature/humidity cycling test of 1,000 hours.

The reaction conditions VI of the table represent a further embodiment of the present invention and a member fabricated under these reaction conditions is similar to the structure of the embodiment shown in FIG. 4. More specifically, the thicknesses of the high resistance layers are increased toward the outer surface. Boron is doped in all the layers and carbon is doped in the high resistance layers for the purpose of increasing the resistance value. Doping of carbon is achieved by using a methane gas. Oxygen is also doped in the low resistance layers as well as the first layer structure 2. This electrophotographic photosensitive member made under the conditions VI showed the excellent resolution even after the paper running test of 30,000 sheets and also showed the excellent resolution even after the temperature/humidity cycling test of 1,000 hours.

In fabricating the above described embodiments, formation of the respective layers was carried out by using a glow discharge process as mentioned. Alternatively, however, a sputtering process, an ion implantation process and any other suitable process may be employed. For example, a sputtering process may be employed in fabricating of the present electrophotographic photosensitive member, by employing a silicon target, and by employing an argon gas, a hydrogen gas and any other suitable impurity gases as necessary.

An impurity for increasing the resistance value of amorphous silicon may be selected from oxygen, carbon, the group III elements, and the group V elements. The resistance value and the thickness of the respective layers may be properly changed for the purpose of achieving the desired properties. Furthermore, the number of the high resistance layers and the low resistance layers in the second layer structure 50 may be suitably changed for the purpose of achieving the desired properties.

Although the present invention has been described and illustrated in detail, it is clearly understood that the same is by way of illustration and example only and is not to be taken by way of limitation, the spirit and scope of the present invention being limited only by the terms of the appended claims.

FIGS. 1 and 4 show that the second layer structure 50 is thinner than the first layer structure 2, and that there are at least two low resistance layers 4*a*, 4*b* and at least two high resistance layers 3*a*, 3*b*, and possibly a third high resistance layer, arranged in alternate succession. The lower resistance layers preferably have the same composition and thickness as shown in the table.

TABLE

| conditions | | $SiH_4$ (cc/min.) | $NH_3/SiH_4 + NH_3$ | $B_2H_6/SiH_4$ (PPM) | $O_2/SiH_4$ | $CH_4/SiH_4$ | $H_2/SiH_4$ | Thickness |
|---|---|---|---|---|---|---|---|---|
| I | 1st layer | 300 | 0 | 10 | 0.01 | 0 | 0.3 | 20 μm |

TABLE-continued

| conditions | | $SiH_4$ (cc/min.) | $NH_3/SiH_4 + NH_3$ | $B_2H_6/SiH_4$ (PPM) | $O_2/SiH_4$ | $CH_4/SiH_4$ | $H_2/SiH_4$ | Thickness |
|---|---|---|---|---|---|---|---|---|
| | 2nd layer | | | | | | | |
| | 3a | 100 | 0.6 | 0 | 0 | 0 | 0.3 | 1000Å |
| | 4a | 100 | 0 | 100 | 0 | 0 | 0.3 | 100Å |
| | 3b | 100 | 0.6 | 0 | 0 | 0 | 0.3 | 1000Å |
| | 4b | 100 | 0 | 100 | 0 | 0 | 0.3 | 100Å |
| | 3c | 100 | 0.6 | 0 | 0 | 0 | 0.3 | 1000Å |
| II | 1st layer | 300 | 0 | 10 | 0.01 | 0 | 0.3 | 20 μm |
| | 2nd layer | | | | | | | |
| | 3a | 100 | 0.6 | 0 | 0 | 0 | 0.3 | 100Å |
| | 4a | 100 | 0 | 100 | 0 | 0 | 0.3 | 100Å |
| | 3b | 100 | 0.6 | 0 | 0 | 0 | 0.3 | 500Å |
| | 4b | 100 | 0 | 100 | 0 | 0 | 0.3 | 100Å |
| | 3c | 100 | 0.6 | 0 | 0 | 0 | 0.3 | 1000Å |
| III | 1st layer | 300 | 0 | 10 | 0.01 | 0 | 0.3 | 20 μm |
| | 2nd layer | | | | | | | |
| | 3a | 100 | 0.2 | 0 | 0 | 0 | 0.3 | 1000Å |
| | 4a | 100 | 0 | 100 | 0 | 0 | 0.3 | 100Å |
| | 3b | 100 | 0.4 | 0 | 0 | 0 | 0.3 | 1000Å |
| | 4b | 100 | 0 | 100 | 0 | 0 | 0.3 | 100Å |
| | 3c | 100 | 0.6 | 0 | 0 | 0 | 0.3 | 1000Å |
| IV | 1st layer | 300 | 0 | 10 | 0.01 | 0 | 0.3 | 40 μm |
| | 2nd layer | | | | | | | |
| | 3a | 100 | 0.6 | 0 | 0 | 0 | 0.3 | 1000Å |
| | 4a | 100 | 0 | 100 | 0 | 0 | 0.3 | 100Å |
| | 3b | 100 | 0.6 | 0 | 0 | 0 | 0.3 | 1000Å |
| | 4b | 100 | 0 | 100 | 0 | 0 | 0.3 | 100Å |
| | 3c | 100 | 0.6 | 0 | 0 | 0 | 0.3 | 1000Å |
| V | 1st layer | 300 | 0 | 10 | 0.01 | 0 | 0.3 | 20 μm |
| | 2nd layer | | | | | | | |
| | 3a | 100 | 0 | 10 | 0.02 | 0 | 0.3 | 1000Å |
| | 4a | 100 | 0 | 100 | 0.01 | 0 | 0.3 | 100Å |
| | 3b | 100 | 0 | 10 | 0.05 | 0 | 0.3 | 1000Å |
| | 4b | 100 | 0 | 100 | 0.01 | 0 | 0.3 | 100Å |
| | 3c | 100 | 0 | 10 | 0.1 | 0 | 0.3 | 1000Å |
| VI | 1st layer | 300 | 0 | 10 | 0.01 | 0 | 0.3 | 20 μm |
| | 2nd layer | | | | | | | |
| | 3a | 100 | 0 | 10 | 0 | 0.3 | 0.3 | 100Å |
| | 4a | 100 | 0 | 100 | 0.01 | 0 | 0.3 | 100Å |
| | 3b | 100 | 0 | 10 | 0 | 0.3 | 0.3 | 300Å |
| | 4b | 100 | 0 | 100 | 0.01 | 0 | 0.3 | 100Å |
| | 3c | 100 | 0 | 10 | 0 | 0.3 | 0.3 | 500Å |
| VII | | 300 | 0 | 10 | 0.01 | 0 | 0.3 | 20 μm |

What is claimed is:

1. An electrophotographic photosensitive member, comprising: a conductive substrate, a first layer structure including a single layer made mainly of amorphous silicon formed on said substrate, said single layer functioning as a photoconductive layer, and a second layer structure (50) also functioning as a photosensitive or photoconductive layer structure including a plurality of individual layers each made mainly of amorphous silicon formed on said single layer, said individual layers of said second layer structure comprising at least two high resistance layers having a relatively higher resistance value and at least one low resistance layer having a relatively lower resistance value than said relatively higher resistance value, said low resistance layer being sandwiched between said high resistance layers, said at least two high resistance layers and said at least one low resistance layer being alternately layered on said single layer of said first layer structure, such that the first and last layers of said second layer structure comprise said high resistance layers, whereby the resistance in the surface of said second layer structure (50) is increased and the resistance in the cross-direction of said second layer structure (50) is decreased.

2. The electrophotographic photosensitive member in accordance with claim 1, wherein said at least two high resistance layers comprise a component selected from the group consisting of oxygen, carbon, the elements belonging to group III of the periodic table, and the elements belonging to group V of the periodic table.

3. The electrophotographic photosensitive member in accordance with claim 1, wherein said at least one low resistance layer comprises a component selected from the group consisting of oxygen, carbon, the elements belonging to group III of the periodic table, and the elements belonging to group V of the periodic table.

4. The electrophotographic photosensitive member in accordance with claim 1, wherein the relatively higher resistance values of said at least two high resistance layers are increasing from said single layer toward an outer surface of said member.

5. The electrophotographic photosensitive member in accordance with claim 1, wherein said at least two high resistance layers have a thickness which increases or decreases toward an outer surface of said member.

6. The electrophotographic photosensitive member in accordance with claim 1, wherein each of said at least two high resistance layers and said at least one low resistance layer has a thickness in the range of 10 Å to 200 μm.

7. The electrophotographic photosensitive member in accordance with claim 1, wherein the relatively higher resistance values of said at least two high resistance layers are larger than $10^9$ Ωcm, and wherein the relatively lower resistance value of said at least one low resistance layer is smaller than 1/10 of the resistance values of said high resistance layers.

8. The electrophotographic photosensitive member in accordance with claim 1, wherein said high and low resistance layers include an impurity so that the energy levels at the bottoms of the conduction bands thereof are even with each other in the case where the electrophotographic photosensitive member is of the positive charging type.

9. The electrophotographic photosensitive member in accordance with claim 8, wherein said impurity is selected from the group consisting of oxygen, carbon, the elements belonging to group III of the periodic table, and the elements belonging to group V of the periodic table.

10. The electrophotographic photosensitive member in accordance with claim 1, wherein said high and low resistance layers include an impurity so that the energy levels at the tops of the valence bands thereof are even with each other in the case where the electrophotographic photosensitive member is of the negative charging type.

11. The electrophotographic photosensitive member in accordance with claim 10, wherein said impurity is selected from the group consisting of oxygen, carbon, the elements belonging to group III of the periodic table, and the elements belonging to group V of the periodic table.

12. A method of manufacturing an electrophotographic photosensitive member, comprising the following steps: preparing a conductive substrate, forming a first layer structure including a single photoconducting layer made mainly of amorphous silicon on said substrate and forming a second photosensitive or photoconducting layer structure including a plurality of individual layers each made mainly of amorphous silicon on said single photoconducting layer, said step of forming said second photosensitive or photoconductive layer structure comprising forming a first high resistance layer having a relatively higher resistance value, forming, on said first high resistance layer, a low resistance layer having a relatively lower resistance value than said relatively higher resistance value, and forming a further high resistance layer on said low resistance layer, said further high resistance layer having a relatively higher resistance value than said relatively lower resistance value, whereby said low resistance layer is sandwiched between said high resistance layers so that the first and last layers of said second layer structure are said high resistance layers, and whereby the resistance in the surface of said second layer structure is increased and the resistance in the cross-direction of said second layer structure is decreased.

13. The method of manufacturing an electrophotographic photosensitive member in accordance with claim 12, wherein said steps of forming said first layer structure, of forming said high resistance layers, and of forming said low resistance layer are carried out by using a glow discharge process in a predetermined atmosphere comprising a gas including at least silicon and hydrogen.

14. The method of manufacturing an electrophotographic photosensitive member in accordance with claim 13, wherein said predetermined atmosphere for use in said step of forming said high resistance layers further comprises an impurity gas including an element selected from the group consisting of oxygen, carbon, the elements belonging to group III of the periodic table, and the elements belonging to group V of the periodic table.

15. The method of manufacturing an electrophotographic photosensitive member in accordance with claim 13, wherein said predetermined atmosphere for use in the step of forming said low resistance layer further comprises an impurity gas including an element selected from the group consisting of oxygen, carbon, the elements belonging to group III of the periodic table, and the elements belonging to group V of the periodic table.

16. The method of manufacturing an electrophotographic photosensitive member in accordance with claim 14, further comprising increasing the amount of said impurity gas in said predetermined atmosphere when forming said second high resistance layers as compared to the amount of said impurity gas in said predetermined atmosphere during the forming of said first high resistance layer.

17. The method of manufacturing an electrophotographic photosensitive member in accordance with claim 12, wherein said steps of forming said high resistance layers are performed by varying respective formation parameters so that said high resistance layers are formed with an increased or decreased thickness.

18. The method of manufacturing an electrophotographic photosensitive member in accordance with claim 13, which further comprises the step of subjecting said substrate to a glow discharge in an atmosphere of at least one gas selected from the group consisting of an argon gas, a hydrogen gas, and a carbon tetrafluoride gas.

19. The method of manufacturing an electrophotographic photosensitive member in accordance with claim 13, wherein said predetermined atmosphere in said step of forming said first layer structure further comprises an oxygen gas.

20. The method of manufacturing an electrophotographic photosensitive member in accordance with claim 12, wherein said steps of forming said first layer structure, said high resistance layers, and said low resistance layer comprises a sputtering process with a silicon target and using at least hydrogen gas as a sputter gas.

21. The method of manufacturing an electrophotographic photosensitive member in accordance with claim 12, wherein said steps of forming said first layer structure, said high resistance layers, and said low resistance layer comprise an ion implantation process.

22. The electrophotographic photosensitive member of claim 1, wherein said first layer structure (2) is thicker than said second layer structure (50).

23. The electrophotographic photosensitive member of claim 1, wherein said second layer structure (50) comprises at least two higher resistance layers and at least two lower resistance layers arranged in alternate succession.

24. The electrophotographic photosensitive member of claim 23, wherein said at least two lower resistance layers have the same composition and the same layer thickness.

* * * * *